US005893470A

United States Patent [19]

Peggs

[11] Patent Number: 5,893,470

[45] Date of Patent: Apr. 13, 1999

[54] UNIVERSALLY REPLACEABLE DISPLAY SHELF FOR REFRIGERATED FOOD CASES

[76] Inventor: Johnny L. Peggs, West Covina, Calif.

[21] Appl. No.: 08/835,176

[22] Filed: Apr. 7, 1997

[51] Int. Cl.[6] ..... A47F 5/08

[52] U.S. Cl. ..... 211/90.01

[58] Field of Search ..... 211/90.01, 90.02

[56] References Cited

U.S. PATENT DOCUMENTS

| | | | |
|---|---|---|---|
| 2,927,666 | 3/1960 | Braviak . | |
| 3,556,306 | 1/1971 | Shell | 211/90 |
| 5,472,103 | 12/1995 | Merl | 211/187 |
| 5,477,789 | 12/1995 | Von Gunten | 108/108 |

OTHER PUBLICATIONS

Prior literature of The Peggs Company of a "Universsal Shelf" and drawing of shelf (undated) 2 sheets.

*Primary Examiner*—Alvin Chin-Shue
*Assistant Examiner*—Sarah Purol

[57] ABSTRACT

A universal replacement display shelf for refrigerated food cases that may be mounted to food cases having case mounting elements mounted with varying longitudinal spacings for mounting shelves on the food cases. The replacement shelf includes shelf mounting brackets having shelf mounting elements securable to the coacting case mounting elements fixed to the case. The shelf mounting brackets are longitudinally slidable to be adjustably securable to the replacement shelf in accordance with the spacing of the individual food case mounting elements and thereby universally applicable.

17 Claims, 4 Drawing Sheets

S

H-3
S-3
FS
M
PT
H-1
S-1
SBT
H-2
SB

H-1
CS
N
S-1
T

FA
SB
SBT
BM

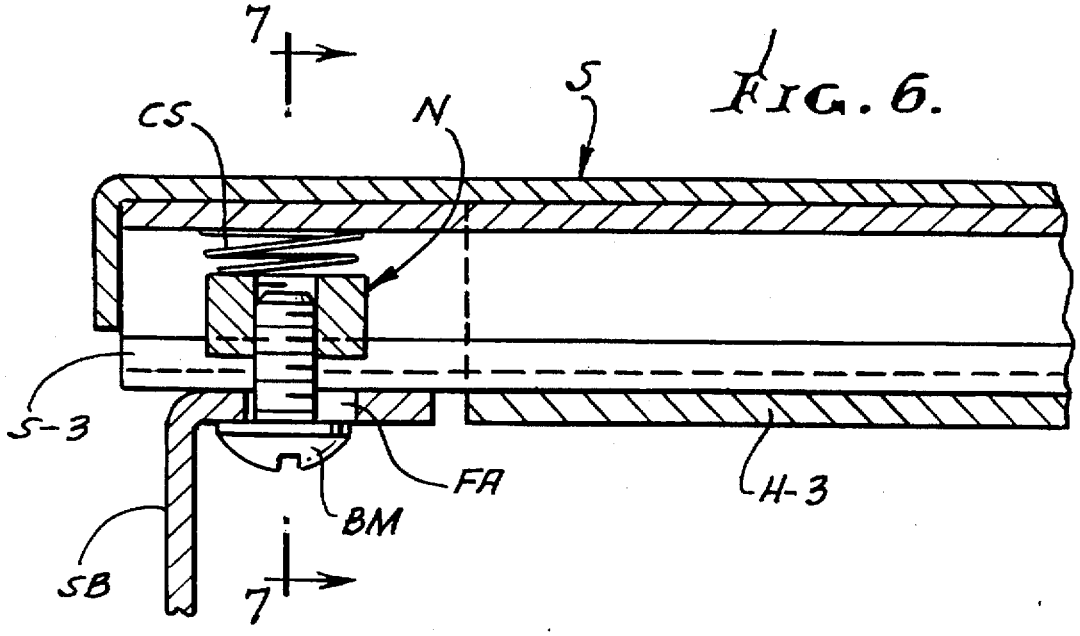
FIG. 6.
FIG. 7.
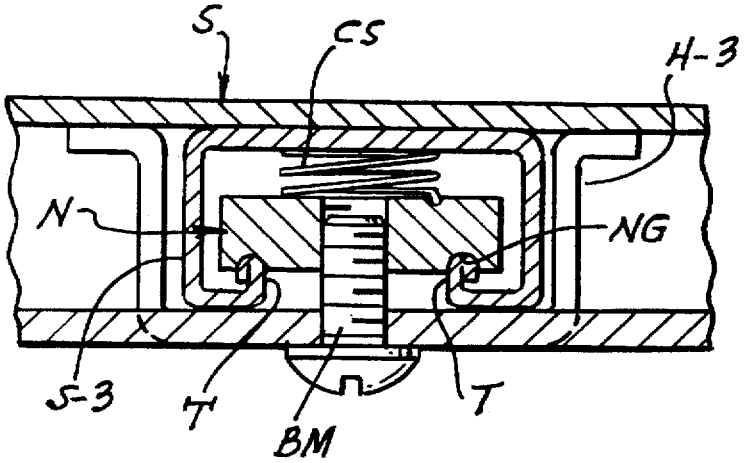
FIG. 8.
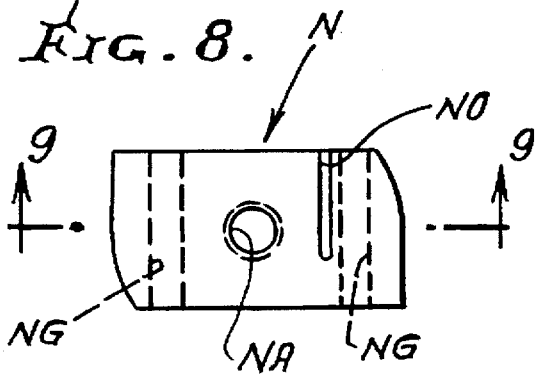
FIG. 9.
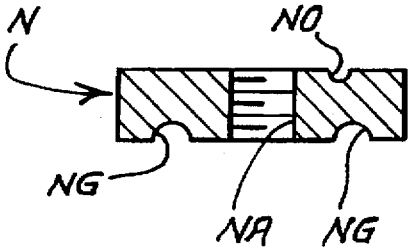

UNIVERSALLY REPLACEABLE DISPLAY SHELF FOR REFRIGERATED FOOD CASES

BACKGROUND OF INVENTION

This invention relates to an improved Universally Replaceable, Display Shelf for Refrigerated Food Cases as utilized in present day food markets or the like. The principal type of refrigerated food cases under consideration is the open ended type of case that is designed and manufactured to store and display dairy, deli, meat or produce items or frozen foods. These food items are stored on a plurality of shelfs mounted to the food cases and may be readily removed from the shelves of the food cases by the food market's customers or employees without resorting to opening a food case door to obtain access to a desired food item. These refrigerated food cases are largely used by the supermarket industry. The major suppliers of this type of refrigerated food cases design the cases so that the shelves are not interchangeable so that a replacement shelf must be obtained from the specific manufacturer of the food case. The food market's purchasing department, must know the manufacturer of the food case and the specific model of case and the size of the shelf to be replaced to place an order for the desired shelf or shelves.

In present day supermarkets the refrigerated food cases in many of the markets originate from more than one supplier of refrigerated food cases. In fact, some markets have refrigerated food cases which are no longer being manufactured and sold by the original manufacturer, although the manufacturer may still be in the business. Other markets have such refrigerated food cases that have been refurbished resulting in the identification of the manufacturer and/or model number or the like have been either removed from the food case or covered over rendering it illegible. To further complicate the problem of shelf replacement for these food cases is the fact that the supermarket stores grow in number either due to expansion or new construction and/or acquisition of existing stores or an entire supermarket chain, the need to know the manufacturer and model number or type of each refrigerated food case in each individual market creates a larger and larger problem of inventoring the food cases for shelf replacement. Some of the supermarket food chains extend over a wide geographical area and even in multiple states so that a centrally located purchasing department without specific manufacturing information relating to the food cases or cases that require shelves to be replaced is faced with an enormous problem and usually has no inventory listing of the type of food case, etc. nor the time to take a store by store inventory for this purpose. At the present time, there is no known, replaceable shelf for refrigerated food case that can be used to replace the shelves for all the major manufacturers of these food cases without the need for specific manufacture's data on each food case in order to effectively replace these shelves in an efficient and expedient manner.

BRIEF SUMMARY OF THE INVENTION

The present invention provides an improved, replacement display shelf for a refrigerated food case that is readily adjustable for use in all presently known refrigerated food cases that may be ordered by merely specifying the desired size of the shelf to be replaced. The improved replacement shelf can be readily and simply installed in a refrigerated food case in a minimum amount of time and without need to resort to the use of highly skilled workers. Once installed, the replacement shelf is continuously maintained in a stable position, even when shelves having depths on the order of 24 inches are required to be mounted to the food case for storing heavy food items such as milk containers (various sizes), butter, eggs and the like.

From a broad structural position, the universal replacement display shelf for the refrigerated food cases of the type under consideration comprises a replacement display shelf having a preselected fixed length to extend between a pair of spaced, fixed mounting elements on the food cases and a preselected width along with a pair of shelf brackets adjustably securable adjacent opposite ends of the shelf in accordance with the spacing of the mounting posts and including adjustable means for securably mounting the shelf brackets to the spaced mounting elements for the food cases and thereby the shelf thereto.

Specifically, the universal display shelf comprises a reinforced shelf for supporting goods thereon and a pair of shelf brackets adjustably mountable to laterally, spaced, fixed shelf mounting elements having female receptacles for lockably securing the shelf brackets having the coacting male securing elements mountable into said female receptacles. The shelf brackets being constructed and defined for slidable longitudinal, adjustment for securement to the shelf in accordance with the final spacing of the shelf mounting posts to permit the secured shelf to carry and store heavy food items.

BRIEF DESCRIPTION OF THE SEVERAL VIEWS OF THE DRAWING

These and other features of the present invention may be more fully appreciated when considered in the light of the following specification and drawings, in which:

FIG. 6 is a sectional view, taken along the line 6—6 of FIG. 5;

FIG. 7 is a sectional view, taken along the line 7—7 of FIG. 6;

FIG. 8 is a top view of the detached spring nut of FIG. 7; and

FIG. 9 is a sectional view of the spring nut taken along the line 9—9 of FIG. 8.

DETAILED DESCRIPTION OF THE INVENTION

Figure 1:
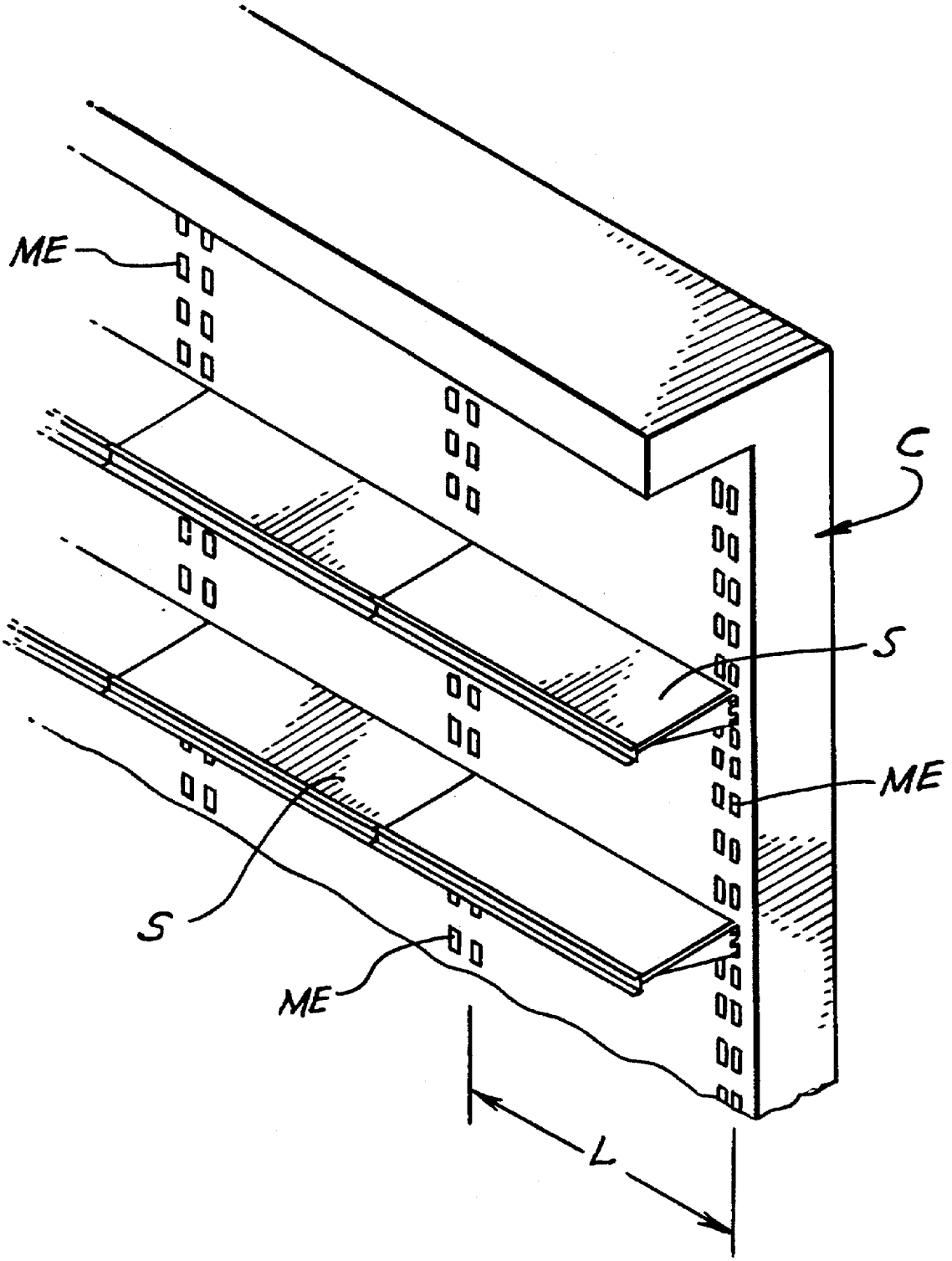
FIG. 1 is a partial, front elevational view of a typical refrigerated food case having the universal replaceable shelf of the present invention mounted thereon.

Now referring to the drawings, the presently preferred embodiment of the replaceable shelf S for a refrigerated food case C will be described in detail. The refrigerated food case is of a commercially available construction of the type utilized for the multi-tier display and storage of dairy products, deli products and the like having an open display end to permit a store customer and/or employee to have access to the stored refrigerated products on the shelves, without the need to open a door, as is evident in FIG. 1. For the purposes of facilitating the description and understanding of the present invention, it should be noted that the presently available refrigerated food cases each are provided with spaced, shelf mounting elements each constructed and defined with female shelf mounting receptacles vertically spaced thereon in preselected increments, such as one inch or the like, for mounting the display shelves at the desired elevations in the food cases C. These shelf mounting elements are illustrated in FIG. 1 in a longitudinal spaced relationship on the food case C and identified as the elements ME. A major problem for the supermarket industry is providing a universal replacement display shelf S for the food cases C is due to the fact the shelf mounting elements ME of the different manufacturers are longitudinally spaced at different dimensions L, as seen in FIG. 1, so that the display shelves of different food cases can not be universally used for the food cases of different food case-manufacturers. Accordingly, there is a present need for a universal, replacement display shelf that can be readily and inexpensively mounted to all food case for replacement purposes without the need of inventory data of the manufacturer or manufacturers of the refrigerated food case and/or cases.

Referring specifically to FIGS. 2–9 wherein the detailed construction of the universal replacement, display shelf S is illustrated will be described with reference thereto. The shelf S of the present invention has a flat side FS for receiving, storing and displaying the food items thereon. The outer edge of the shelf S may include an aluminum price tag moulding PT secured thereto, as is conventional, illustrated on the left hand side of FIG. 2. The opposite side of the shelf S from the flat side FS is constructed and defined with a plurality of spaced reinforcing means extending between the longitudinal edges of the shelf and secured to the shelf by welding or the like. The reinforcing means are formed of a U-shaped, conventional configuration, commonly referred to as hat sections, and identified in the drawings as hat sections H-1, H-2 and H-3 on the back side BS of the shelf S. The hat section H-2 extends between opposite ends of the shelf S, as illustrated, while the hat sections H-1 and H-3 terminate at a preselected distance from the adjacent ends of the shelf S, see FIGS. 2 and 4. The hat sections H-1 and H-3 mount slide channels therein extending between the opposite longitudinal ends of the shelf S, as best appreciated from viewing FIGS. 2 and 5. The slide channels are identified as the channels S-1 and S-3 for the hat sections H-1 and H-3 respectively and are formed of a U-like configuration interfitting within the respective hat sections and extending outwardly therefrom and terminating at the longitudinal edges of the shelf S. Each slide channel S-1 and S-2 is constructed and defined with integral tracks T spaced from the inner side walls thereof for slidably receiving a fastening element to ride thereon; see FIGS. 3, 6 and 7.

Figure 2:
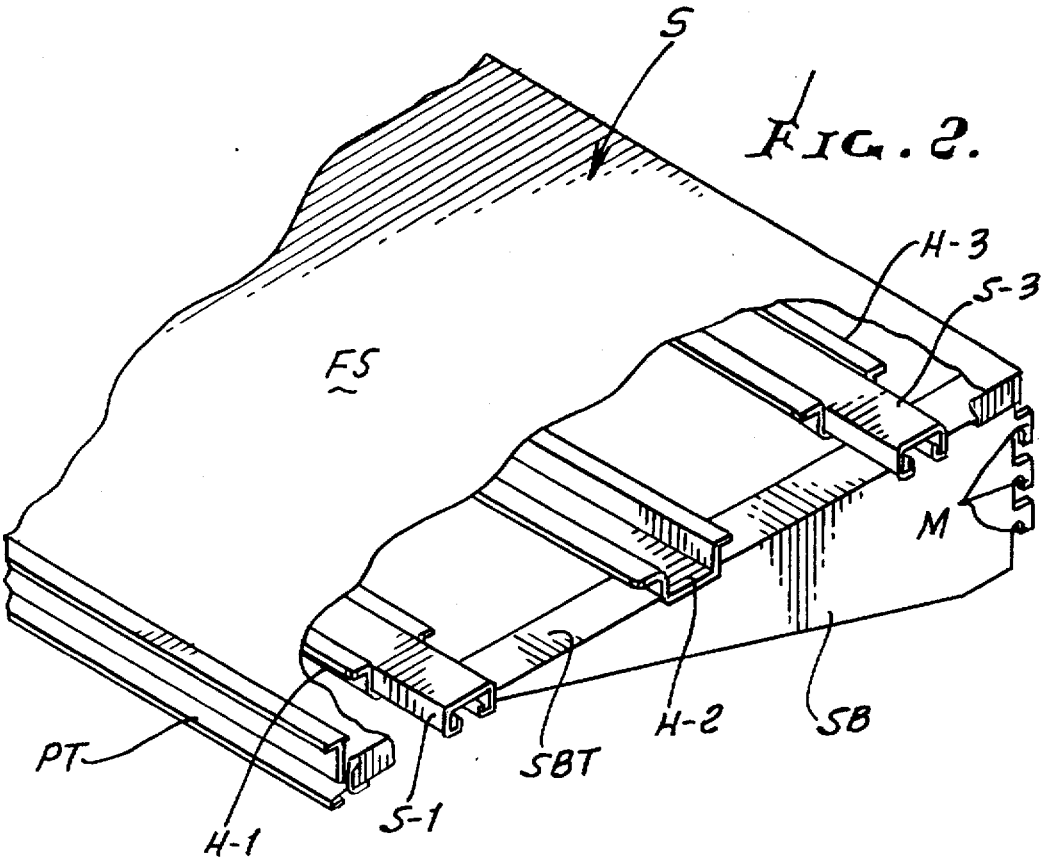
FIG. 2 is a partial, end view, with portions broken away of a replaceable shelf bracket secured thereto and detached from the refrigerated food case and embodying the invention.
Figure 3:
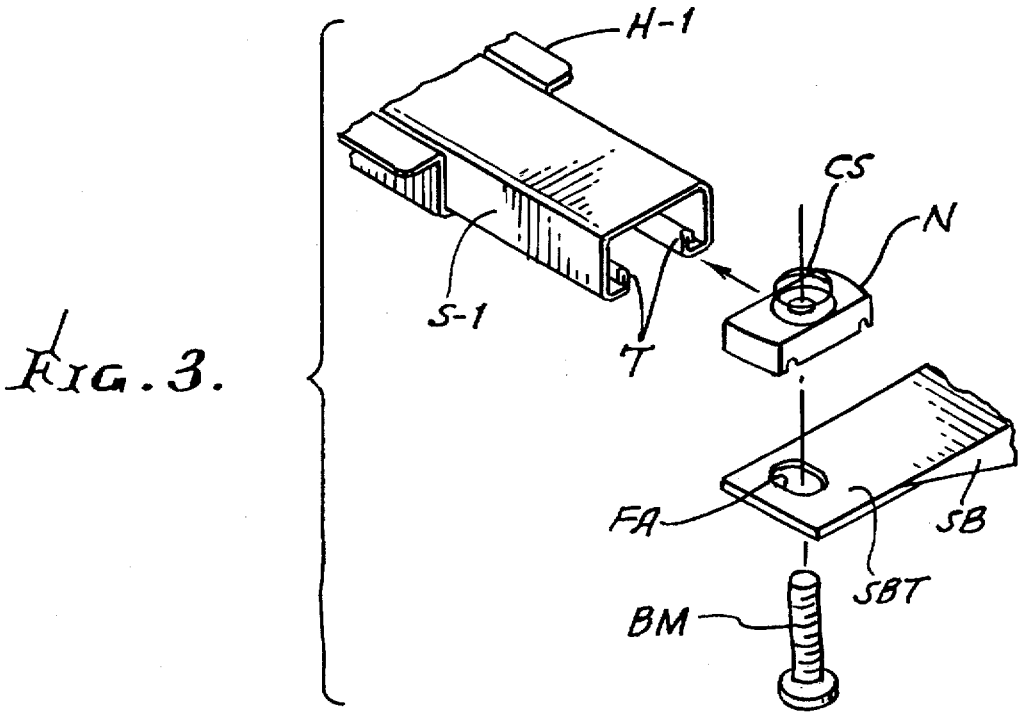
FIG. 3 is an exploded view of terminal portion of the detached slide channel and hat for the replaceable shelf illustrated in FIG. 2 along with a portion of the shelf bracket illustrating the relationship of the fastening elements therewith.
Figure 4:
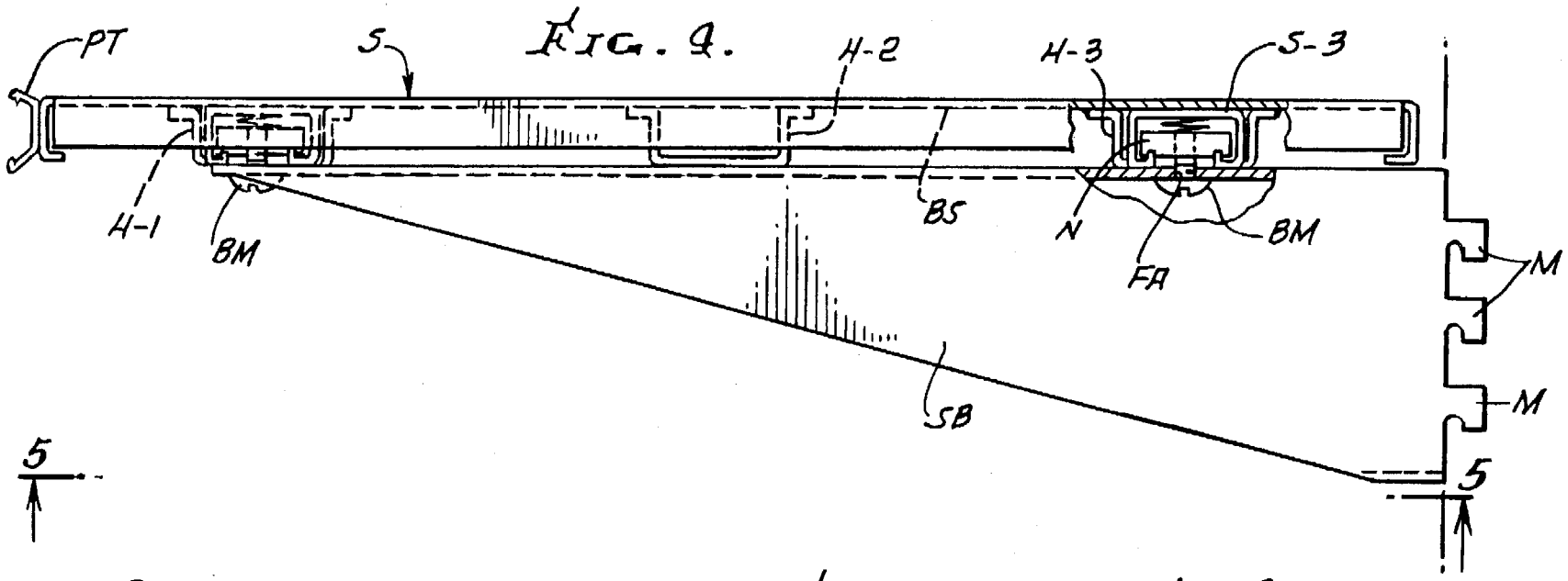
FIG. 4 is a side elevational view, with portions broken away and others in dotted outline, of assembly of the replacement shelf as illustrated in FIG. 2.
Figure 5:
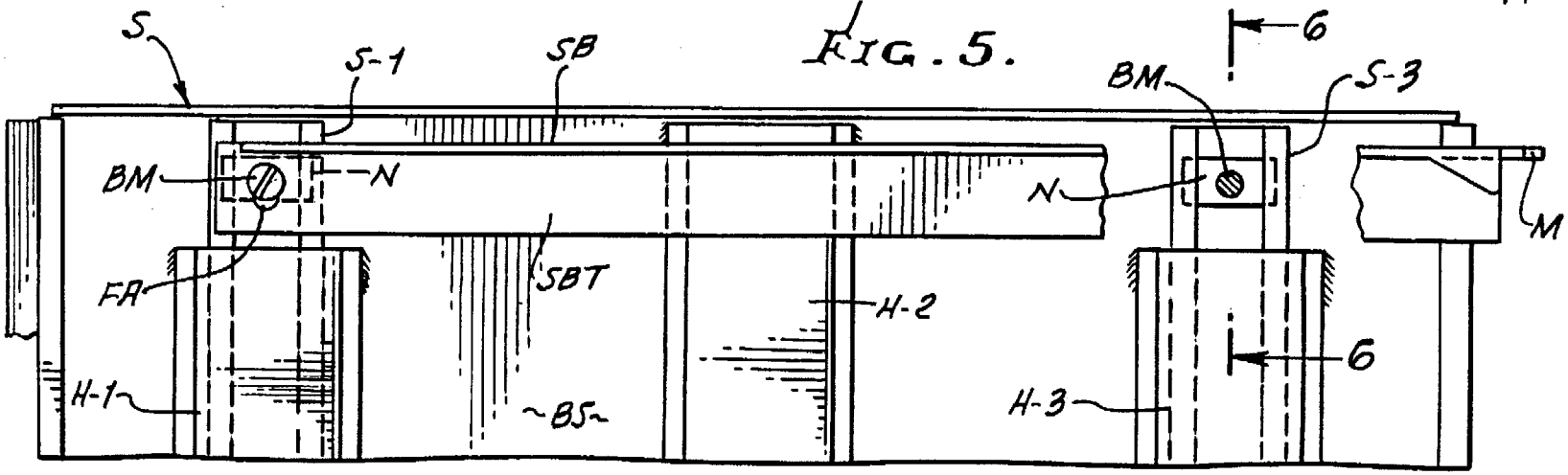
FIG. 5 is a sectional view, taken along the line 5—5 of FIG. 4, of the replacement shelf.

The shelf S of the present invention includes a pair shelf brackets SB of the same construction and having a L-cross section and a substantially, triangular configuration, as seen in FIGS. 2–4. The right hand side of the triangular side, the right hand side thereof, as viewed in FIGS. 2 and 3 having a plurality of spaced male mounting elements M, spaced apart in accordance with the case mounting elements ME so as to be secured therein and thereby mounting the shelf S to the food case C when the bracket SB is secured to the shelf S. The top sides of the shelf brackets SB have a longitudinally extending securing platform SBT for securing the brackets to the shelf. For this purpose the platforms SBT is provided with a pair of spaced apertures FA arranged to be spaced intermediate the side walls of the slide channels S-1 and S-3. The apertures FA, preferably have an oval like shape for receiving the bolt member BM therein at the threaded stud thereof and with the bolt head engaging the bottom side of the platform SBT. The nut means N of the shelf bracket SB fastening means is threaded to receive the bolt stud of members BM for securing the bracket SB and shelf S together. In this secured arrangement, the nut meansNis slidably received within the slide channels S-1 and S-3 for slidably riding on the tracks T, as shown for the slide channel S-3 in FIGS. 4 and 6. The nut means N is illustrated as a spring nut having a compression spring CS secured to the top side thereof, as illustrated and will be described more fully hereinafter.

The nut means N has a substantially rectangular cross-sectional configuration with a substantially central, threaded aperture NA (see FIG. 9) for receiving the threaded shank of the bolt member BM for securing the shelf bracket SB. The compression spring CS mounts on the top side of the nut means N or the side opposite from the bolt head for the bolt member and over the nut aperture NA, see FIGS. 6 and 7, for example. To secure the spring CS to the nut means N, the top side of the nut means has a longitudinally extending notch NO for seating one end of the spring CS; see FIG. 7. The opposite side of the nut means N from the notch NO side is provided with a pair of spaced grooves NG constructed and defined and spaced to slide over the tracks T provided for the slide channels S-1 and S-3. This arrangement secures the shelf S and shelf bracket SB together and allows the adjustment of of the shelf bracket SB by the nut means N sliding over the tracks T to interfit the bracket mounting elements M with the coacting case mounting elements ME and thereby securing the shelf S to the food case C.

With the above construction in mind, the ease with which the shelf S can be secured to the food case C will now be described with reference to the variable dimension L for the food case mounting elements ME. At the present time, the major refrigerated food cases available have a maximum spacing of 47⅞ inches and a minimum distance of 46 inches. The shelf S of the present invention accomodates this difference of 1⅞ inches to render it universally applicable to all of these food cases by the adjustment permitted between the shelf S and the shelf bracket SB through the sliding action of the nut means N on the tracks T of the slide channels S-1 and S-3. When the shelf S is to be mounted to a food case C, the installer loosely secures the shelf bracket SB to the shelf S in a manner to allow longitudinal adjustment of the nut means N. In this loose condition, the shelf S is mounted to the case C by interengaging the mounting elements M of the shelf brackets and the elements ME of the food case. When in this position, the nut means N for the two shelf brackets SB will have been moved in alignment with the case mount elements ME to span the dimension L, whatever it may be. At this time, the installer can tightly secure the four fastening elements or the bolt member BM and the nut means N to finalize the installation.

I claim:

1. A universal replacement, display shelf for refrigerated food cases or the like used to replace the shelves of refrigerated food cases of different manufacturing sources and each having laterally spaced, vertically extending shelf mounting elements on the food cases for adjustably mounting shelf brackets and shelves between a pair of fixed spaced mounting elements secured to said cases, each food case of a different manufacture having a different fixed dimension between the spaced shelf mounting elements, the improvement comprising a replacement shelf having a preselected fixed length to extend between a pair of said fixed spaced mounting elements and a preselected width, a pair of shelf brackets securable to opposite ends of said shelf and each bracket including means at one end thereof for securably mounting the shelf to one of a pair of fixed spaced case shelf mounting elements, and means for securing said shelf and shelf brackets longitudinally adjustable of the shelf for permitting the securement of the shelf brackets to said shelf in in accordance with the fixed spacing between the shelf mounting elements for a food case and securable in the longitudinally adjusted position.

2. A replacement, display shelf for a refrigerated food case, said shelf having a preselected, fixed length, and a preselected width, one side of the shelf being constructed and designed for receiving and storing food items thereon and the opposite side thereof having reinforcing means thereon, and a pair of shelf brackets adjustably mountable to opposite ends of the shelf, said shelf bracket and said opposite side of the shelf being constructed and designed to permit adjustable securement of the shelf brackets lengthwise of the shelf to permit the shelf brackets to be horizontally secured and longitudinally adjustable to a food case between fixed points on the food case.

3. A universal replacement display shelf as defined in claim 1 or 2 wherein the securing means for securing the shelf bracket to the shelf includes spring mounted fastening means secured between the bracket and the shelf reinforcing means for securing the shelf and the shelf bracket together.

4. A universal replacement display shelf as defined in claim 2 wherein said reinforcing means includes hollow channel means for permitting adjustable securement of each shelf bracket to the shelf between fixed, but variable points on the food case.

5. A universal replacement display shelf as defined in claim 4 wherein a pair of fastening elements adjustably secure each shelf bracket to the shelf.

6. A universal replacement display shelf for refrigerated food cases wherein each food case has laterally spaced, vertically extending shelf mounting elements of a fixed lateral spacing thereon, each mounting element having a plurality of female mounting sockets vertically spaced thereon for permitting shelves to be secured thereto in preselected, fixed vertical increments, the replacement shelf having a preselected, fixed length sized to the lateral, spacing of the mounting elements and a preselected width, one side of the shelf being flat for receiving and storing foods thereon and the opposite side of the shelf having a plurality of longitudinally extending slide channel means spaced thereon for reinforcing the shelf, the opposite ends of said slide channels being spaced from the adjacent ends of the shelf, and a pair of shelf brackets having an end with a plurality of outwardly extending male securing elements arranged in a vertically spaced arrangement in accordance with the spacing of the female mounting sockets of the food case for locking engagement therewith, and fastening means comprising a threaded bolt and a threaded nut for securing the shelf mounting brackets to the shelf with the nut being adjustably slidable along the slide channel for permitting the shelf brackets to be mounted to the shelf mounting elements for the food case in accordance with the fixed lateral spacing thereof on said case.

7. A universal replacement display shelf as defined in claim 6 wherein each slide channel means has a U-like cross-sectional configuration with integrally formed, upwardly extending track means formed thereon, and said nut of said fastening means having spaced grooves thereon for sliding movement along said track means including when said male securing elements of the bracket means are mounted to said female mounting elements of the food cases.

8. A universal replacement display shelf for refrigerated food cases or the like used to replace the shelves of refrigerated food cases of different manufacturing sources and each having laterally spaced, vertically extending shelf mounting elements on the food cases for adjustably mounting shelf brackets and shelves between a pair of fixed, spaced mounting elements secured to said cases, each food case of a different manufacture having a different, fixed dimension between the spaced shelf mounting elements, the replacement display shelf having a preselected length to extend between a pair of said spaced mounting elements and a preselected width, a pair of shelf brackets adjustably securable to opposite ends of the shelf and each including shelf mounting elements extending outwardly thereof for complimentary securement to said shelf mounting elements for said food case to permit food items to be mounted thereon, the replacement shelf having one side thereof constructed and defined for storing and displaying food items thereon and the opposite side of said shelf including a plurality of longitudinally extending reinforcing cap means wherein at least a pair of said reinforcing cap means include a U-like slide channel terminating adjacent the opposite sides of the shelf and constructed and defined for slidably receiving fastening means therein, and shelf fastening means secured at spaced locations on the shelf brackets corresponding to the locations of said slide channels for the shelf to permit longitudinally adjustable securement of the shelf brackets and said shelf by said fastening means including when the shelf brackets are secured in said shelf mounting elements for a food case.

9. A universal replacement display shelf as defined in claim 8 wherein said fastening means comprises nut means constructed and defined for longitudinal movement along said slide channels and a bolt securable to the shelf brackets and the nut means to permit longitudinal adjustment of the shelf brackets to the shelf in accordance with the fixed spacing of the mounting elements for a food case.

10. A universal replacement display shelf as defined in claim 8 wherein said U-like slide channels include upstanding slide tracks to permit said fastening means to slide along said channels.

11. A universal replacement display shelf as defined in claim 9 wherein said nut means for the fastening means is constructed and defined as a spring nut for mounting the fastening means to said U-like slide channels.

12. A universal replacement display shelf as defined in claim 11 wherein said U-like slide channels include vertically extending track means and said fastening means include nut means for mounting to said track means, said nut means having groove means for slidably moving along said track means for the slide channels.

13. A universal replacement display shelf as defined in claim 12 including spring means mounted to each of said means and extending between the nut means and the slide channels therefore.

14. A method of mounting a universal replacement display shelf for refrigerated food cases having mounting elements spaced at different longitudinal dimensions, the steps including the step of providing a replacement display shelf of a preselected length to extend between a pair of mounting elements and a preselected width, each display shelf having a plurality of spaced slide channels arranged on the non-food display side of the replacement shelf and extending longitudinally between but spaced from the opposite ends of the replacement shelves, providing a shelf bracket securable adjacent each end of the replacement shelf, loosely securing each shelf bracket to the display shelf by fastening elements secured to a shelf bracket at the ends of the shelf slide channels for permitting longitudinal sliding movement of the fastening elements within the slide channels, mounting the shelf brackets to the spaced mounting elements of the food case by adjustably sliding the fastening elements in said slide channels until the spacing of the mounting elements of the food case is achieved and the shelf is mounted there between, and then tightly securing each shelf bracket to the shelf in their adjusted locations spaced the same as the mounting elements for the food case.

15. A method of mounting a display shelf for a display shelf construction having mounting elements spaced at fixed longitudinal dimensions, the steps including the step of providing a display shelf of a preselected length to extend between a pair of fixed mounting elements and a preselected width each display shelf having a plurality of spaced slide channels arranged on the non-display side of the shelf and extending longitudinally between but spaced from the opposite ends of the shelf, providing a shelf bracket securable adjacent each end of the shelf, loosely securing each shelf bracket to the display shelf by fastening elements secured to a shelf bracket at the ends of the shelf slide channels for permitting longitudinal sliding movement of the fastening elements within the slide channels, mounting the shelf brackets to the fixed spaced mounting elements by adjustably sliding the fastening elements in said slide channels until the spacing of the mounting elements is achieved and the shelf is mounted there between, and then tightly securing each shelf bracket to the shelf in their adjusted locations spaced the same as the fixed mounting elements.

16. A display shelf construction including laterally spaced, vertically extending shelf mounting elements of a fixed lateral spacing thereon, each shelf mounting element having a plurality of female mounting sockets vertically thereon for permitting shelves to be secured thereto in preselected, fixed vertical increments, the shelf having a preselected, fixed length sized to the lateral spacing of the mounting elements and a preselected width, one side of the shelf being flat for receiving and storing items thereon and the opposite side of the shelf having a plurality of longitudinally extending slide channel means spaced thereon for reinforcing the shelf, the opposite ends of said slide channels being spaced from the adjacent ends of the shelf, and a pair of shelf brackets having an end with a plurality of outwardly extending male securing elements arranged in a vertically spaced arrangement in accordance with the spacing of said female mounting sockets for locking engagement therewith, and fastening means comprising a threaded bolt and a threaded nut for securing the shelf mounting brackets to the shelf with the nut being adjustably slidable along the slide channel for permitting the shelf brackets to be mounted to the shelf mounting elements in accordance with the fixed lateral spacing thereof.

17. A display shelf construction as defined in claim 16 wherein each slide channel means has a U-like cross-sectional configuration with integrally formed, upwardly extending track means formed thereon, and said nut of said fastening means having spaced grooves thereon for sliding movement along said track means including when said male securing elements of the bracket means are mounted to said female mounting elements.

* * * * *

UNITED STATES PATENT AND TRADEMARK OFFICE

CERTIFICATE OF CORRECTION

PATENT NO. : 5,893,470

DATED : April 13, 1999

INVENTOR(S) : Johnny L. Peggs

It is certified that error appears in the above-identified patent and that said Letters Patent is hereby corrected as shown below:

Title page, item [73], add the Assignee as following:

The Peggs Company, Inc. of
Riverside, CA 91752

Title page,
Add the Attorney as follows:

Edward J. DaRin, Esq.

Signed and Sealed this

Sixth Day of February, 2001

*Attest:*

*Attesting Officer*

Q. TODD DICKINSON

*Director of Patents and Trademarks*